US007600839B2

(12) United States Patent
Akama et al.

(10) Patent No.: US 7,600,839 B2
(45) Date of Patent: Oct. 13, 2009

(54) RECORDING APPARATUS WHICH CAN PREVENT BLOCK SWITCHING NOISES

(75) Inventors: Yuichiro Akama, Kawasaki (JP); Kimiyuki Hayasaki, Yokohama (JP); Masahiko Ogawa, Hino (JP); Yasunori Takei, Meguro-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 278 days.

(21) Appl. No.: 11/609,130

(22) Filed: Dec. 11, 2006

(65) Prior Publication Data

US 2007/0153036 A1 Jul. 5, 2007

(30) Foreign Application Priority Data

Dec. 26, 2005 (JP) ..... 2005-372521

(51) Int. Cl.
*B41J 29/38* (2006.01)

(52) U.S. Cl. ..... 347/12

(58) Field of Classification Search ..... 347/12, 347/9, 10

See application file for complete search history.

(56) References Cited

U.S. PATENT DOCUMENTS 4,376,942 A * 3/1983 Toth et al. ..... 347/186
5,584,997 A 12/1996 Yagihashi et al.
5,885,454 A 3/1999 Yagihashi et al.
5,975,670 A * 11/1999 Kikuta et al. ..... 347/15
6,102,510 A * 8/2000 Kikuta et al. ..... 347/9
6,243,111 B1 * 6/2001 Imanaka et al. ..... 347/13
6,280,012 B1 * 8/2001 Schloeman et al. ..... 347/12
6,375,295 B1 * 4/2002 Ghozeil et al. ..... 347/12
6,460,976 B1 * 10/2002 Oikawa ..... 347/57
6,705,694 B1 * 3/2004 Barbour et al. ..... 347/9
6,824,237 B2 * 11/2004 Hirayama et al. ..... 347/9
2004/0201638 A1 * 10/2004 Imai ..... 347/10

FOREIGN PATENT DOCUMENTS

JP 7-068761 A 3/1995

* cited by examiner

*Primary Examiner*—Matthew Luu
*Assistant Examiner*—Shelby Fidler
(74) *Attorney, Agent, or Firm*—Canon U.S.A., Inc., IP Division

(57) ABSTRACT

A recording head circuit is configured to drive a plurality of recording elements by dividing the plurality of recording elements into a plurality of blocks. The circuit delays not only heat signals, which are used to drive the recording elements in each of the blocks, but also block signals. Consequently, noises are prevented from appearing due to overlapping of signals.

6 Claims, 11 Drawing Sheets

FIG.9

| DECODER INPUT LEVELS | | | | DECODER OUTPUT LEVELS | | | | | | | | | | | | | | | |
|---|---|---|---|---|---|---|---|---|---|---|---|---|---|---|---|---|---|---|---|
| ENB_ 3 | ENB_ 2 | ENB_ 1 | ENB_ 0 | BLOCK_ 15 | BLOCK_ 14 | BLOCK_ 13 | BLOCK_ 12 | BLOCK_ 11 | BLOCK_ 10 | BLOCK_ 9 | BLOCK_ 8 | BLOCK_ 7 | BLOCK_ 6 | BLOCK_ 5 | BLOCK_ 4 | BLOCK_ 3 | BLOCK_ 2 | BLOCK_ 1 | BLOCK_ 0 |
| L | L | L | L | L | L | L | L | L | L | L | L | L | L | L | L | L | L | L | H |
| L | L | L | H | L | L | L | L | L | L | L | L | L | L | L | L | L | L | H | L |
| L | L | H | L | L | L | L | L | L | L | L | L | L | L | L | L | L | H | L | L |
| L | L | H | H | L | L | L | L | L | L | L | L | L | L | L | L | H | L | L | L |
| L | H | L | L | L | L | L | L | L | L | L | L | L | L | L | H | L | L | L | L |
| L | H | L | H | L | L | L | L | L | L | L | L | L | L | H | L | L | L | L | L |
| L | H | H | L | L | L | L | L | L | L | L | L | L | H | L | L | L | L | L | L |
| L | H | H | H | L | L | L | L | L | L | L | L | H | L | L | L | L | L | L | L |
| H | L | L | L | L | L | L | L | L | L | L | H | L | L | L | L | L | L | L | L |
| H | L | L | H | L | L | L | L | L | L | H | L | L | L | L | L | L | L | L | L |
| H | L | H | L | L | L | L | L | L | H | L | L | L | L | L | L | L | L | L | L |
| H | L | H | H | L | L | L | L | H | L | L | L | L | L | L | L | L | L | L | L |
| H | H | L | L | L | L | L | H | L | L | L | L | L | L | L | L | L | L | L | L |
| H | H | L | H | L | L | H | L | L | L | L | L | L | L | L | L | L | L | L | L |
| H | H | H | L | L | H | L | L | L | L | L | L | L | L | L | L | L | L | L | L |
| H | H | H | H | H | L | L | L | L | L | L | L | L | L | L | L | L | L | L | L |

RECORDING APPARATUS WHICH CAN PREVENT BLOCK SWITCHING NOISES

BACKGROUND OF THE INVENTION

1. Field of the Invention

The present invention relates to a recording head capable of performing stable printing, and to a recording apparatus adapted to perform recording using the recording head.

2. Description of the Related Art

Various recording heads have been known, on which a plurality of recording elements are arranged in a line or in a plurality of lines. In the recording head of such a kind, several or tens of drive integrated circuits, each of which can simultaneously drive N recording elements as one block, are mounted on the same substrate. Among such recording heads, a recording head including a plurality of electrothermal conversion elements as recording elements, which generate discharge energy used to discharge ink from a discharge port, has been known. Some of such a recording head drives a large number of recording elements and needs a large amount of electric power to drive the recording elements. Additionally, in a case where such a recording head continuously drives a recording element, heat is stored therein to change a recording density. Also, the recording element is affected by heat of an adjacent recording element.

Thus, the following methods have been proposed. One is a method of dividing recording elements into a plurality of blocks, and performing a sequential driving operation of a plurality of recording elements adjoining one another in each of the blocks. Another is a method of dividing recording elements into a plurality of blocks, and performing a distributed driving operation of simultaneously driving a plurality of recording elements positioned relatively distant from one another in each of the blocks.

Meanwhile, in a case where adjacent recording elements are simultaneously driven in an inkjet recording apparatus, nozzles sometimes interfere with one another by mutual pressures generated at ink discharge. This pressure interference (i.e., crosstalk) may cause change in the recording density. Thus, preferably, after a recording element is driven, an idle period is provided to prevent heat dissipation or crosstalk.

To this end, the method of performing the distributed driving operation is effective, especially, in a case where the recording elements to be simultaneously driven are distributed in a columnwise direction. According to this method, the adjacent recording elements are not simultaneously driven. Thus, influence on each recording element from adjacent recording elements can be eliminated by providing the idle period. More specifically, the distributed driving operation is achieved by a plurality of enable terminals connected in common to all the recording elements that can simultaneously be driven. FIG. 7 illustrates a conventional recording element drive circuit of a recording head. Japanese Patent Application Laid-Open No. 7-68761 discusses a similar circuit.

The driving method of the conventional circuit is herein now described. First, an image data transfer clock is transferred from a clock terminal CLK to a shift register circuit 10. Also, image data is transferred from a data signal terminal DATA to the shift register circuit 10. To cause a latch circuit 11 to latch image data, a latch pulse signal is input from a latch terminal LAT. Also, image data are aligned corresponding to the recording elements. In one period of the latch pulse signal, the recording elements can be energized according to the image data in each of blocks. Time-divisional driving is performed on the recording elements in units of blocks. A decoder decodes data representing combinations of on-levels and off-levels of signals ENB_0, ENB_1, ENB_2, and ENB_3 into data respectively representing 16 blocks. Thus, the blocks can be selected. In the period of the latch pulse signal, the blocks are sequentially selected. In a time period corresponding to each of 16 blocks, pulse width regulating signals respectively corresponding to 16 blocks are input from heat enable terminals HEAT_1 and HEAT_2. Consequently, a time-divisional distributed driving operation can be achieved by setting a time-division number at 32. The driving pulse signal applied to each of the recording elements has a pulse width set so that a rise time and a fall time of a functional element (i.e., a driver) 3 are short enough to enable high-resolution control.

However, in a case where the recording head of the above configuration is used to achieve high-speed image formation, high-resolution color image formation, and recording-head miniaturization, the following problems sometimes occur. In increasing the number of recording elements to achieve high-speed image formation and high-resolution color image formation, the number of blocks to be time-divisionally driven or the number of recording elements to be simultaneously driven may increase. However, to achieve high-speed image formation, there is a limit to increase in the number of blocks. Thus, there is a growing tendency towards increase in the number of recording elements to be simultaneously driven.

However, an increase in the number of recording elements to be simultaneously driven results in occurrence of a problem due to recording current concentration in wires. This problem is a malfunction due to switching noises generated at a rise and a fall of a driving pulse signal. For example, in a case where the rise time or the fall time t of the function element 3 is 100 nanoseconds, where self-inductance of the wire is 100 nanohenries, and where a concentrated current flowing in the wire is 1 ampere, an induced voltage V (volts) is calculated as follows:

$$V=L\cdot(di/dt)=100\times10^{-9}\times1/100\times10^{-9}\times1=1 \text{ (volt)}.$$

That is, an induced voltage of 1V is generated as a noise voltage. This noise voltage largely affects a COMS (complementary metal-oxide) or TTL (transistor-transistor logic) logic gate circuit unit. Especially, in a case where the logic gate circuit unit is a CMOS logic circuit having an operating voltage of 3.3V or less, this level of the noise voltage substantially reaches a threshold level. Thus, sometimes, a malfunction occurs in a recording head device including both a control block, which has the function element 3 adapted to switch a large current, and a COMS or TTL logic gate circuit unit constituting the shift register and the latch circuit.

The switching noise at the simultaneous driving has hitherto been a problem. Thus, several countermeasures against the switching noise have been known. For example, a method of stepwise delaying driving pulse signals applied to recording elements to be driven as recording-elements of the same block has been known. According to this method, a delay element is configured to stepwise delay timing, with which a driving pulse signal is applied to each of the recording elements, according to a pulse width regulating signal in view of a level and a width of a switching noise.

However, this method encounters the following problem in a case where the number of recording elements driven in a driving period of 1 block is further increased. That is, although an allowable pulse width time is usually allotted to each of the recording elements so that all the recording elements can be driven in a driving period (i.e., a period in which 1 recording element is continuously driven), a sufficient delay time cannot be taken. Consequently, it is difficult to prevent the switching noise from adversely affecting the recording head.

SUMMARY OF THE INVENTION

An aspect of the present invention is to stepwise delay not only a driving pulse signal applied to a recording element but also delay a time-division block signal, and is to provide a recording head substrate and a recording head, which can prevent switching noises, which are generated when recording elements are driven in the same block, from adversely affecting the recording head.

According to an aspect of the present invention, a recording head includes a plurality of recording elements, a block selection unit configured to divide the recording elements into blocks each of which has a plurality of the recording elements, and to select the block according to a time-divisional driving signal used to perform time-divisional driving in units of the blocks, an input unit configured to input a pulse width regulating signal used to regulate a width of a driving pulse signal to be applied to each of the recording elements, a first delay circuit configured to delay timing, with which a driving pulse signal is applied to recording elements included in the block selected by the block selection unit, and a second delay circuit configured to cause the block selection unit to delay the time-divisional driving signal.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 illustrates an exemplary decoding operation of a decoding circuit in the recording head circuit according to the embodiment shown in FIG. 11.

DETAILED DESCRIPTION OF THE EMBODIMENTS

Various exemplary embodiments, features, and aspects of the invention will be described in detail below with reference to the drawings.

Figure 10:
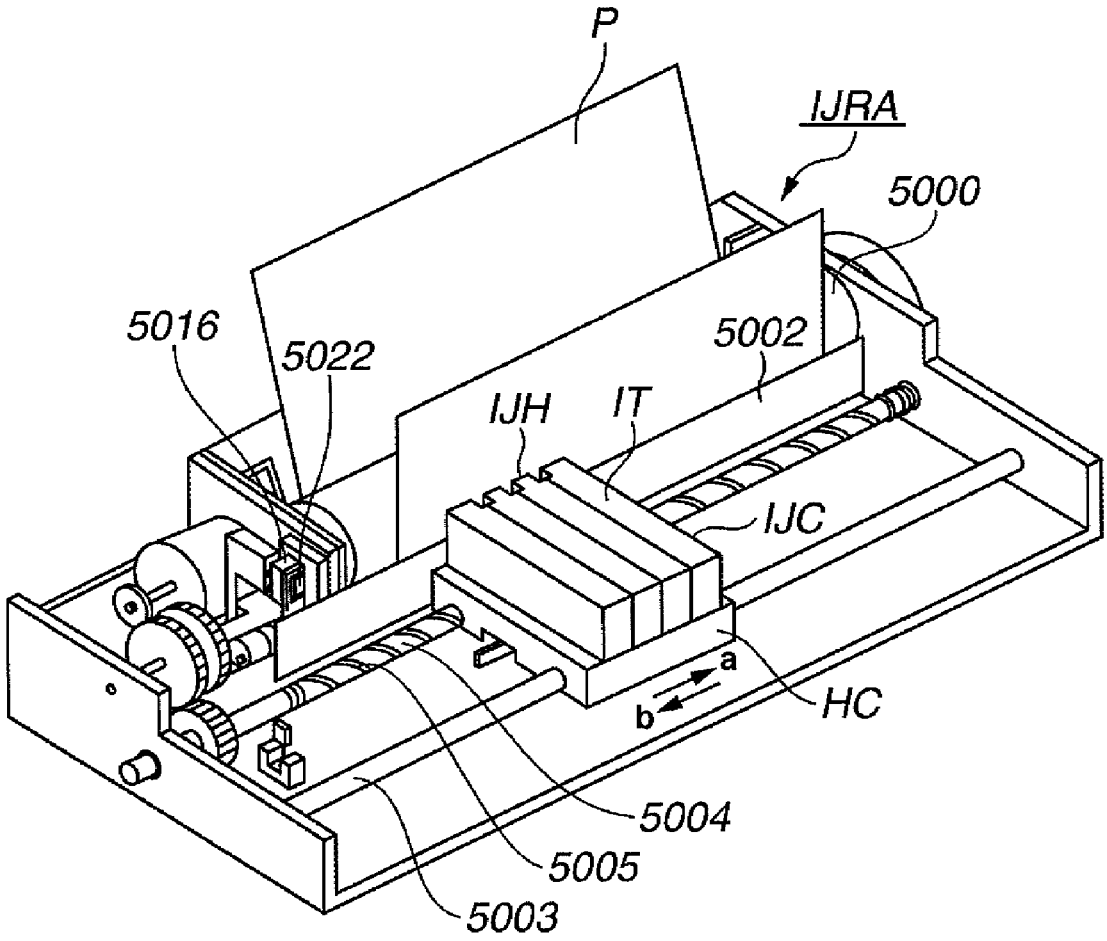
FIG. 10 is a perspective diagram illustrating an exemplary inkjet recording apparatus according to an aspect of the present invention.

FIG. 10 is a perspective diagram illustrating an exemplary inkjet recording apparatus IJRA according to an aspect of the present invention. A carriage HC has a pin (not shown) engaging a spiral groove 5005 of a lead screw 5004. As the lead screw 5004 turns, the carriage HC reciprocates in directions of arrows a and b on a guide rod 5003. An inkjet cartridge IJC is mounted on the carriage HC. The inkjet cartridge IJC has an inkjet head IJH (hereafter referred to as a "head unit") and an ink tank IT that stores recording ink.

A paper pressing plate 5002 presses paper against a platen 5000 along a direction in which the carriage moves. The platen 5000 is rotated by a conveyance motor (not shown) and conveys recording paper P. A member 5016 supports a cap member 5022 adapted to cap a front face of a recording head. Capping, cleaning, and suction recovery operations are performed by the action of the lead screw 5004 when the carriage HC reaches a home-position-side area.

Figure 2:
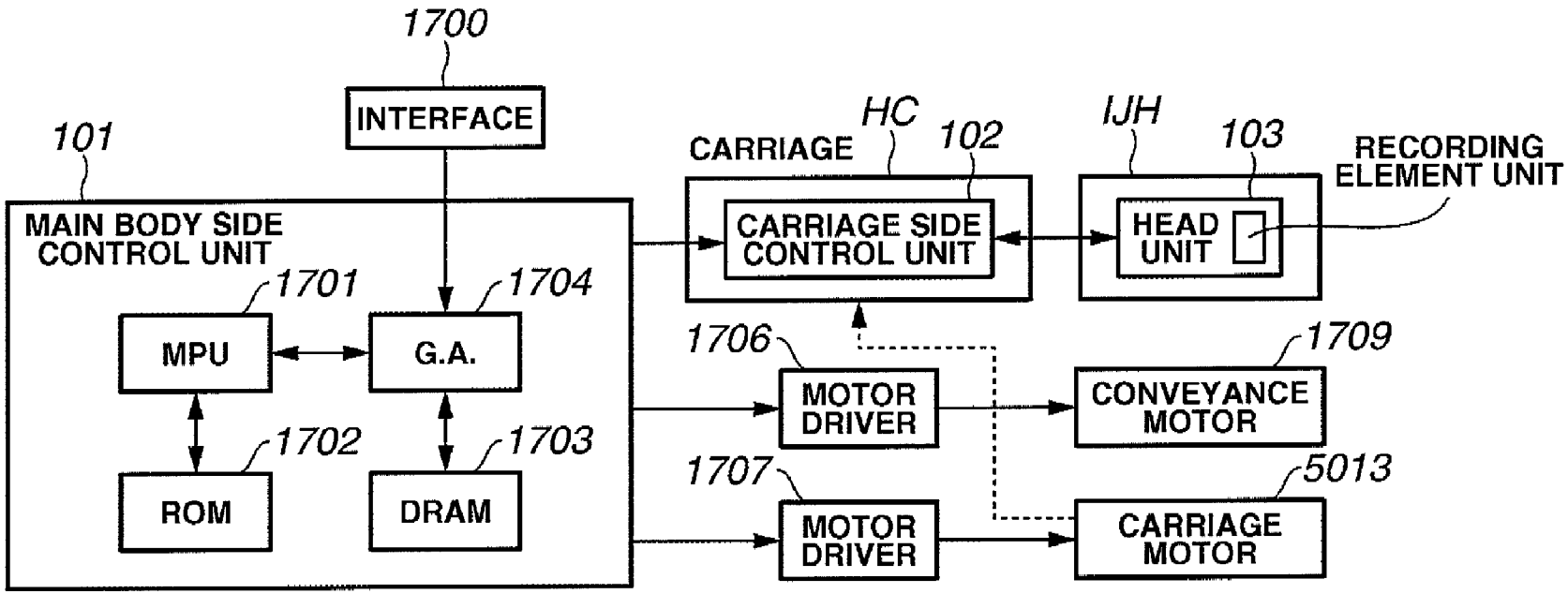
FIG. 2 is a block diagram illustrating an exemplary control unit of an inkjet recording apparatus according to an aspect of the present invention.

Next, an exemplary control system configured to perform recording control operations on the above apparatus is described below with reference to a block diagram illustrated in FIG. 2. A main-body-side control unit 101 includes an input interface 1700 used to input recording signals, a microprocessing unit (MPU) 1701, a program read-only memory (ROM) 1702 configured to store a control program to be performed by the MPU 1701, and a dynamic random access memory (DRAM) 1703 configured to store various data, such as the recording signals and recording data to be supplied to the head. The main-body-side control unit 101 also includes a gate array (G.A.) 1704 configured to supply and control recording data and signals used to drive the head. The gate array 1704 controls data transfer between the gate array 1704 and the interface 1700, between the gate array 1704 and the MPU 1701, and between the gate array 1704 and the RAM 1703.

A conveyance motor 1709 (not shown in FIG. 10) is used to convey recording paper P. A motor driver 1706 is used to drive the conveyance motor 1709. A motor driver 1707 is used to drive a carriage motor 5013.

An exemplary operation of the control system is described below. When the interface 1700 receives a recording signal, the recording signal is sent therefrom via the gate array 1704 to the MPU 1701 that converts the recording signal into recording data. Then, the motor drivers 1706 and 1707 are driven. Also, the inkjet head IJH is driven, via a carriage side control unit 102, according to the recording data sent to the carriage HC. Thus, an image is recorded on the recording paper P.

When a recording element unit of the inkjet head IJH is driven, characteristic information held in a memory (not shown) of the head unit 103 is referred to so as to perform optimal driving thereon. Thus, a mode of driving each of the recording elements is determined. Additionally, in the following description, the inkjet head IJH is referred to simply as a "recording head".

First Exemplary Embodiment

Figure 11:
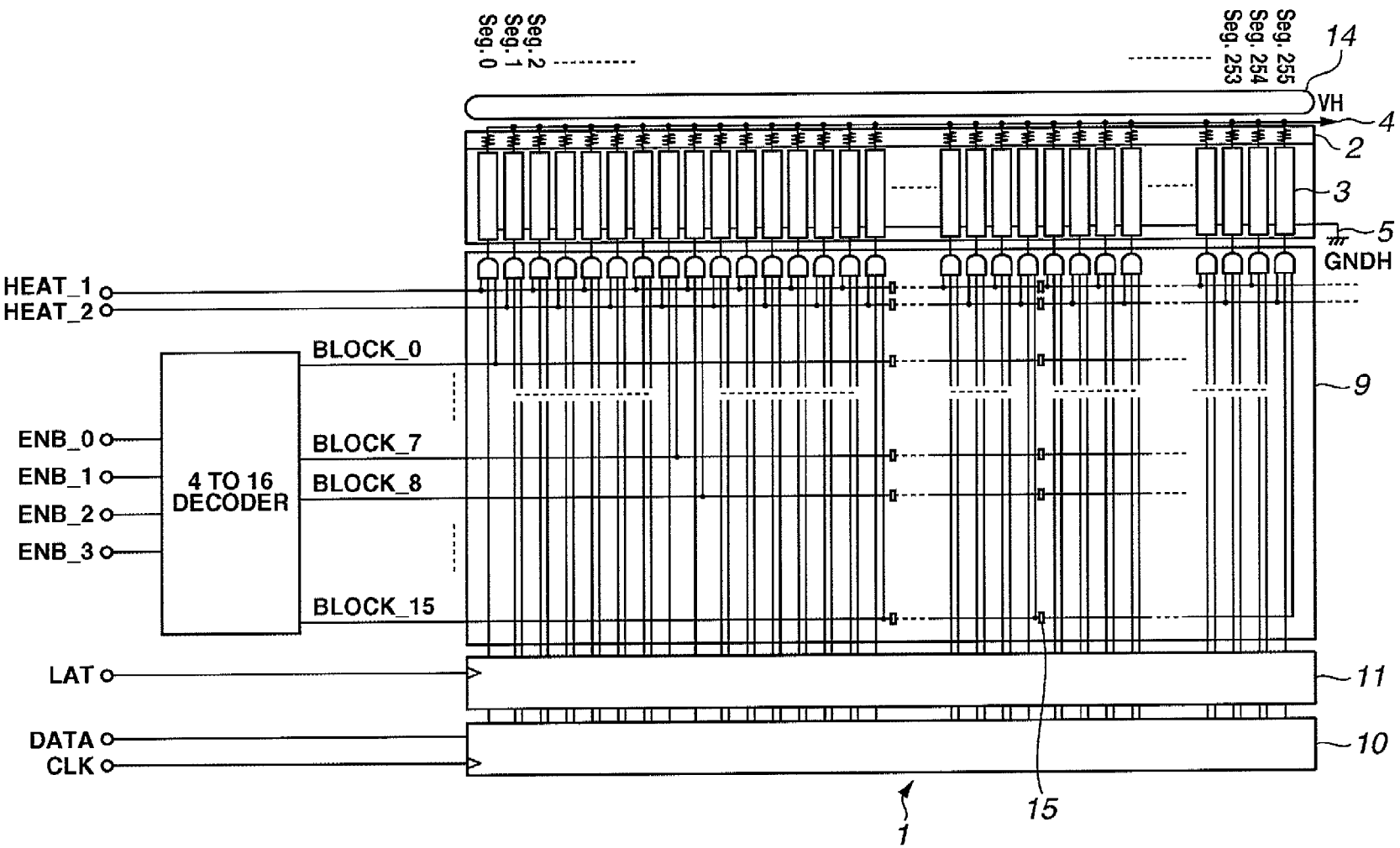
FIG. 11 is a schematic diagram illustrating an exemplary configuration of an inkjet recording head according to an aspect of the present invention.

FIG. 11 schematically illustrates a characterizing portion of a configuration of the recording head IJH to which a first exemplary embodiment of the present invention can be applied. According to the present exemplary embodiment, a plurality of recording elements 2 (a line of 256 recording elements Seg. 0 to Seg. 255) are provided on an inkjet recording head substrate 1. Ink supply ports 14, adapted to supply ink to ink discharge nozzles (not shown) structurally provided above the recording elements, are formed on the substrate by performing anisotropic etching or sandblasting thereon.

The discharge ports of the ink discharge nozzles are provided on a side opposed to the recording element. Recording element columns 2 constituted by electrothermal elements (resistance elements) arranged in a line (the electrothermal elements of each recording element column can be arranged on double-level lines corresponding to a set of several nozzles) are disposed corresponding to the ink supply ports 14. As will be described later in detail, the recording elements are electrically connected to a control circuit to be selectively driven according to recording image data. Next, MOS-FET (Metal Oxide Semiconductor Field Effect Transistor) functional element (driver) columns 3, which are adapted to respectively drive the recording elements 2, and circuit wiring 9 enabling the drivers 3 to control the individual recording elements 2 are disposed. A power supply common electrode (VH) 4 and a power supply grounding common electrode (GNDH) 5 can be disposed across the recording elements 2 and the functional elements 3. Alternatively, the power supply common electrode (VH) 4 and the power supply grounding common electrode (GNDH) 5 can be disposed so that the common electrodes 4 and 5 and the functional elements constitute a multilayer structure. The common electrodes 4 and 5 can be disposed according to the configuration of the inkjet recording head.

Most substrates incorporate not only the recording element columns but the functional element groups such as the driver columns, and the control circuits. This contributes to reducing cost of the entire recording apparatus. Among the elements and the circuits, circuits such as the shift register 10 and the latch circuit 11, play roles in individually controlling the recording element columns placed over hundreds of nozzles. Even in a case where the number of recording elements increases, it is unnecessary to increase the number of control terminals according to the number of recording elements. Thus, an inkjet recording head substrate having a combination of such circuits, which serves as a control circuit, is going mainstream. In a case of an inkjet recording head, a phenomenon called "crosstalk" due to an ink flow occurs. Ink droplets discharged from the discharge nozzle is sometimes unstable due to the crosstalk.

Thus, to prevent adjacent recording elements from being simultaneously driven, the apparatus is adapted so that the adjacent recording elements can be controlled separated from each other. The adjacent recording elements can be controlled by applying energization signals (or pulse width regulating signals) to terminals HEAT_1 and HEAT_2. The recording elements are driven according to an ANDed output of an individual recording element control signal generated by the latch circuit 11, the energization signal, and the time-divisional driving signal. The time-divisional control signal from the time-divisional control signal terminal ENB_0 (or 1, 2, 3) is set to correspond to the driven block of the recording head. There are a wide variety of methods of time division, selection circuits, and configurations of wiring. The method of time division, the selection circuit, and the configuration of wiring according to the present invention are not limited to the above-described method, circuit and configuration.

Each of delay circuits 15 shown in a frame 9 delays a signal by a predetermined time. Also, delay circuits 15 are provided on the time divisional driving signal line BLOCK. The delay time increases in proportion to the number of connected delay circuits.

Figure 5A:
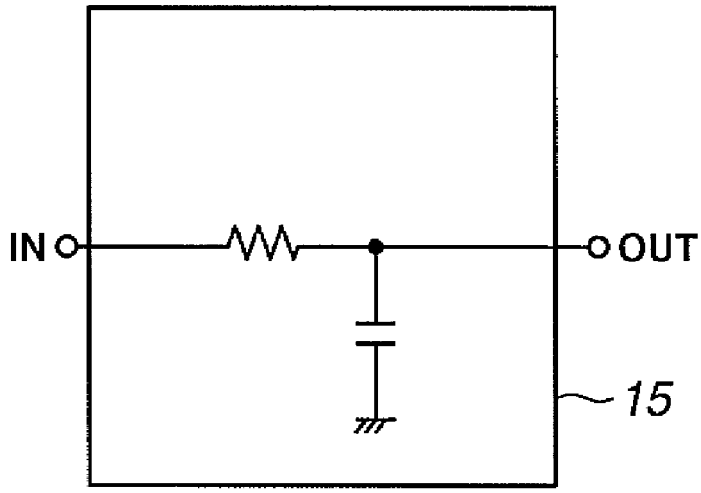
FIGS. 5A and 5B illustrate an exemplary configuration of a delay circuit of the recording head according to an aspect of the present invention.
Figure 5B:
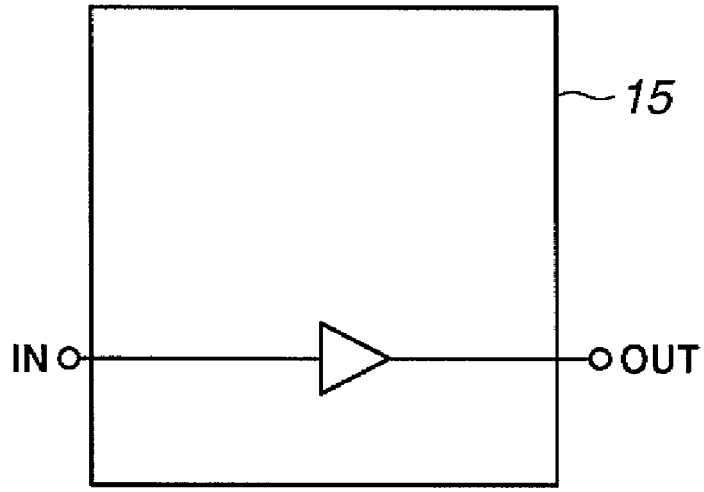

FIGS. 5A and 5B show examples of the delay circuit 15, which are respectively constituted by a low-pass filter and a buffer. The delay time is set according to the rise time or the fall time of a driving current of the recording elements to be simultaneously driven or of an electric current flowing through the recording element. The set delay time ranges from about several ns to about several tens ns. There are various configurations of a circuit that generates a necessary delay time. The circuit adapted to generate a necessary delay time is not limited to that according to the present exemplary embodiment.

Now referring back to FIG. 11, a control terminal pad (not numbered in FIG. 11) is adapted to feed a recording current to the inkjet recording head substrate and to control recording. A plurality of control system wires extended from the time-division driving circuit are provided to run on a surface of the inkjet recording head substrate 1, because the plurality of control system wires are also used in a case where the recording apparatus is colorized.

Figure 8:
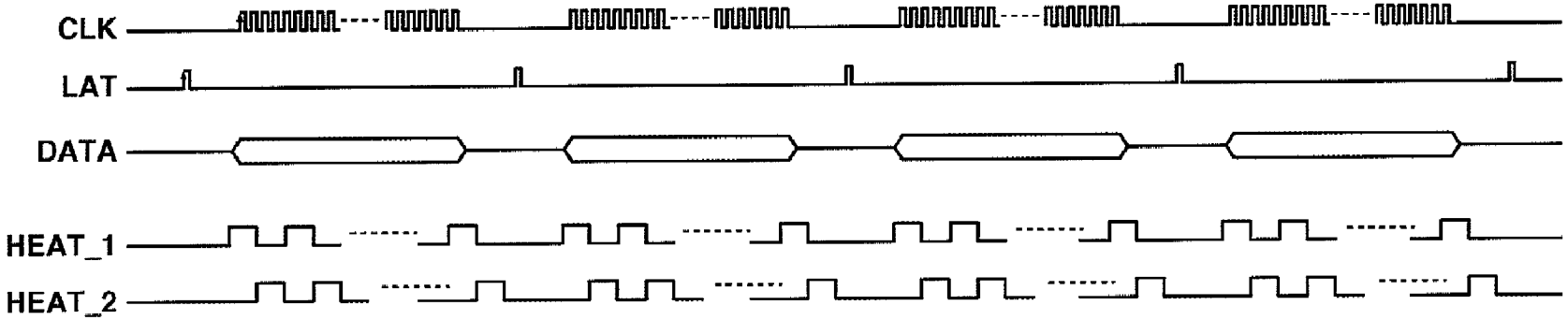
FIG. 8 is a drive timing chart illustrating an exemplary driving operation of a recording head circuit according to the embodiment shown in FIG. 11.

FIG. 8 is a drive timing chart illustrating an exemplary driving operation of the recording head substrate circuit according to the exemplary embodiment shown in FIG. 11. Image data which is developed in the recording apparatus and is recorded by using nozzle columns of the recording head, is input to the terminal DATA. This data is basically serial data and is supplied to the shift register circuit 10. In the present embodiment, the data, whose data width corresponds to 256 recording elements, is temporarily held in the latch circuit 11. A latch clock for holding the data is input to a terminal LAT. The data having been held in the latch circuit 11 is held therein until the next data is input thereto and a latch clock is input again to the terminal LAT.

The 256 recording elements are divided into 16 blocks each having 16 recording elements. Time-divisional driving is performed on the recording elements in units of the blocks. Time-divisional control signals used to perform time-divisional driving are input to terminals ENB_0, ENB_1, ENB_2, and ENB_3. Four time-divisional control signals, each of which has a high level or a low level as shown in FIG. 9, are input to the terminals ENB_0, ENB_1, ENB_2, and ENB_3. The 16 blocks are selected according to an output signal BLOCK_n representing data obtained by decoding.

While the data is held in the latch circuit 11, the 16 blocks (not shown) are serially selected. Then, the energization signals used to energize and control the recording elements are input to the terminals HEAT_1 and HEAT_2 (from FIG. 8). Subsequently, the recording elements are selected according to the image data. A recording current is fed to the recording elements at a pulse width determined by the energization signal (or pulse width regulating signal). The energization signals are applied to the terminals HEAT_1 and HEAT_2 shifted as shown in FIG. 8.

Thus, a total time, in which recording current having a duration equal to the pulse width is applied, can be shortened within a range of a data transfer clock transmission time. This is a method of shortening a period of ink discharge as much as possible to realize a high speed recording apparatus. Thus, to the extent that the circuit shown in FIG. 11 allows, several timing sequences for driving the recording head can be set. According to a print mode of the recording apparatus, timing can be set.

Figure 1:
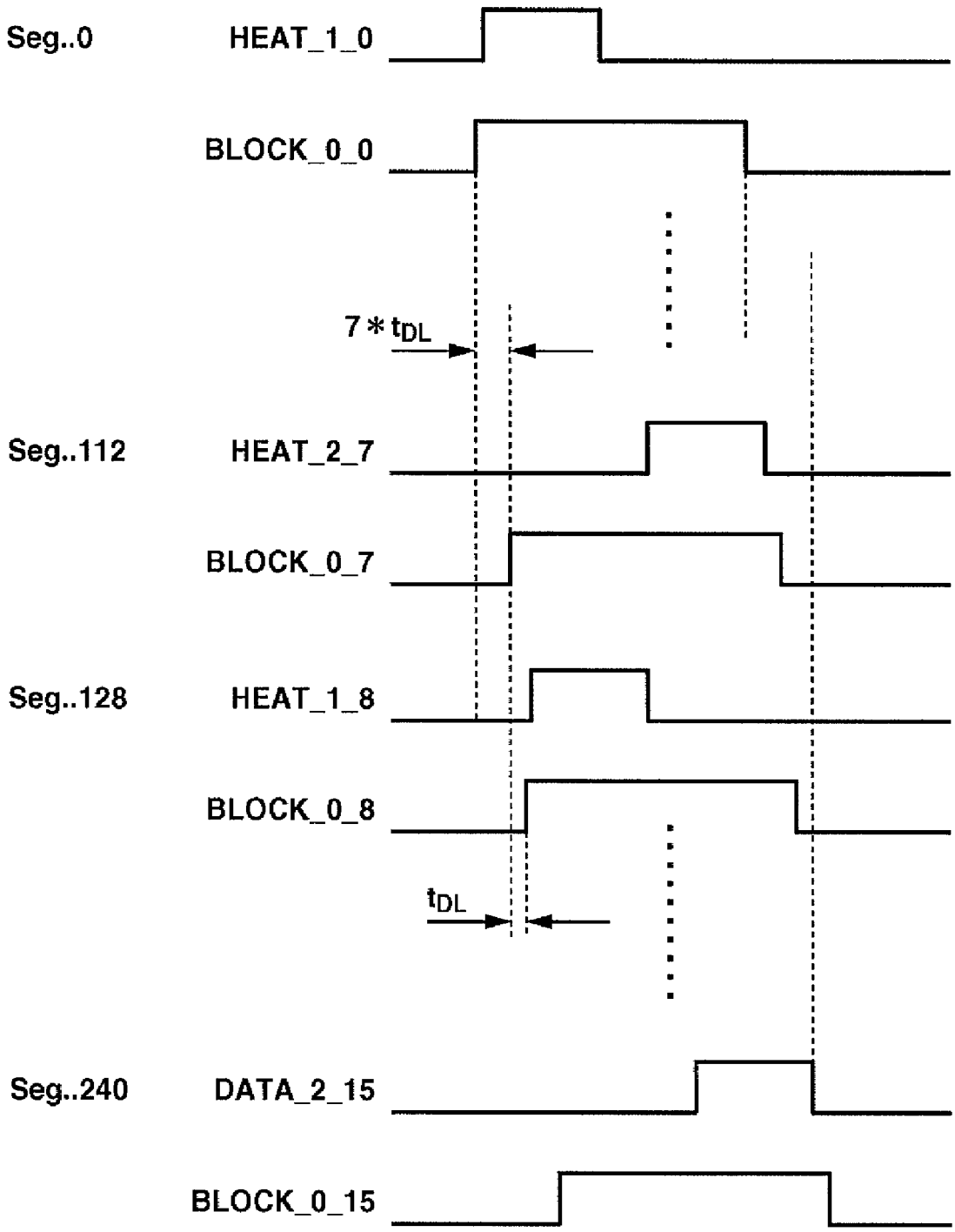
FIG. 1 illustrates exemplary signals input to recording elements of a recording head circuit according to an aspect of the present invention.

FIG. 1 illustrates examples of signals input to recording elements of the recording head circuit shown in FIG. 11. FIG. 1 further illustrates an example of an operation of the delay circuit. In this recording head, no delay is caused by the recording elements Seg. 0 to Seg. 15. A delay period is generated by one delay stage in each of the recording elements Seg. 16 to Seg. 31. Further, delay periods are generated by two delay stages in each of the recording elements Seg. 32 to seg. 47. In the recording elements from Seg. 48 to Seg. 223, the number of delay stages included in each of the recording elements is incremented by 1 every time the number of recording elements is increased by 16. Finally, in each of the recording elements Seg. 224 and Seg. 225, delay periods are generated by 15 delay stages.

A block signal to each of the recording elements different in the number of delay stages is designated by BLOCK_m_n (m is the number of a block signal, and n is the number of delay stages). Also, an energization signal to each of the recording elements different in the number of delay stages is designated by HEAT_1_n and HEAT_2_n (n is the number of delay stages).

FIG. 1 also illustrates especially signals input to the recording elements seg. 0+16n (n is the number of delay stages), because block signals input thereto correspond to the same block signal line (thus, the block signal line BLOCK_0 is common to these block signals) and differ from one another only in the number of delay stages. Energization pulse signals are input to the terminals HEAT_1 and HEAT_2 by delaying input timing so that the pulses respectively corresponding to the terminals HEAT_1 and HEAT_2 are within the width of the pulse signal BLOCK_0. A block signal BLOCK_0_0 is not delayed. However, because each single delay stage generates a delay period $t_{DL}$, a block signal BLOCK_0_7 is delayed from the block signal BLOCK_0_0 by 7 times the delay period $t_{DL}$. Also, a block signal BLOCK_0_15 is delayed from the block signal BLOCK_0_0 by 15 times the delay period $t_{DL}$.

Similarly, the energization signal HEAT_1_0 input to the recording element Seg. 0 is not delayed from the signal HEAT_1. However, the energization signal HEAT_2_7 input to the recording element Seg. 12 is delayed from the signal HEAT_2 by 7 times the delay period $t_{DL}$. Also, the energization signal HEAT_2_15 input to the recording element seg. 240 is delayed from the signal HEAT_2 by 15 times the delay period $t_{DL}$. Therefore, at any nozzle, the pulse signals HEAT_1 and HEAT_2 are present within duration of the pulse BLOCK_0. Thus, a sufficient delay time can be taken. In a case where the signal BLOCK_0 and a signal SMALL_0 are not delayed, similarly to a conventional recording head in which only each energization signal (or hereunder referred to also as "HEAT signal") is delayed but no delay in each block, a pulse signal DATA_1_15 is out of duration of the pulse BLOCK_0_0 (SMALL_0), as is apparent from comparison between the pulses DATA_1_15 and BLOCK_0_0 (SMALL_0). Thus, sufficient energy is not supplied to the recording element Seg. 226. Consequently, the recording element cannot be driven.

According to the present embodiment, in each single recording element, the number of delay stages corresponding to the signal line BLOCK is set to be equal to that of delay stages corresponding to the terminal HEAT_1 (or HEAT_2).

However, generally, the pulse width of the signal BLOCK is set to be wider than that of the signal HEAT to provide a margin. Therefore, in a case where the signal HEAT_1 (or HEAT_2) is present in the duration of the signal BLOCK, the number of delay stages can be reduced. For example, in each recording element, one delay stage is provided corresponding to the signal line BLOCK in a case where two delay stages are provided corresponding to the terminal HEAT_1 (or HEAT_2). Consequently, the present embodiment has an advantage in that the number of delay circuits provided on the signal line BLOCK can be reduced.

Thus, even in a case where the number of recording elements increases, a sufficient delay time can be taken by providing the delay circuit in the block selection unit adapted to selects a block on which time-divisional driving is performed. Consequently, the switching noise can be prevented from adversely affecting the recording head.

The recording head according to the present invention is not limited to a thermal inkjet head of the above-described configuration. That is, as long as recording heads are adapted to perform time-divisional driving on recording elements in units of blocks, each of which has a predetermined number of recording elements, and to drive each of recording elements, which are simultaneously driven in the same block, with a delay, the present invention can be applied to any of such recording heads. Additionally, even in a case of recording heads that are thermal heads other than inkjet heads or are inkjet heads adapted to discharge ink using piezoelectric elements, as long as the recording heads meet the above condition, the present invention can be applied thereto.

Second Exemplary Embodiment

Figure 3:
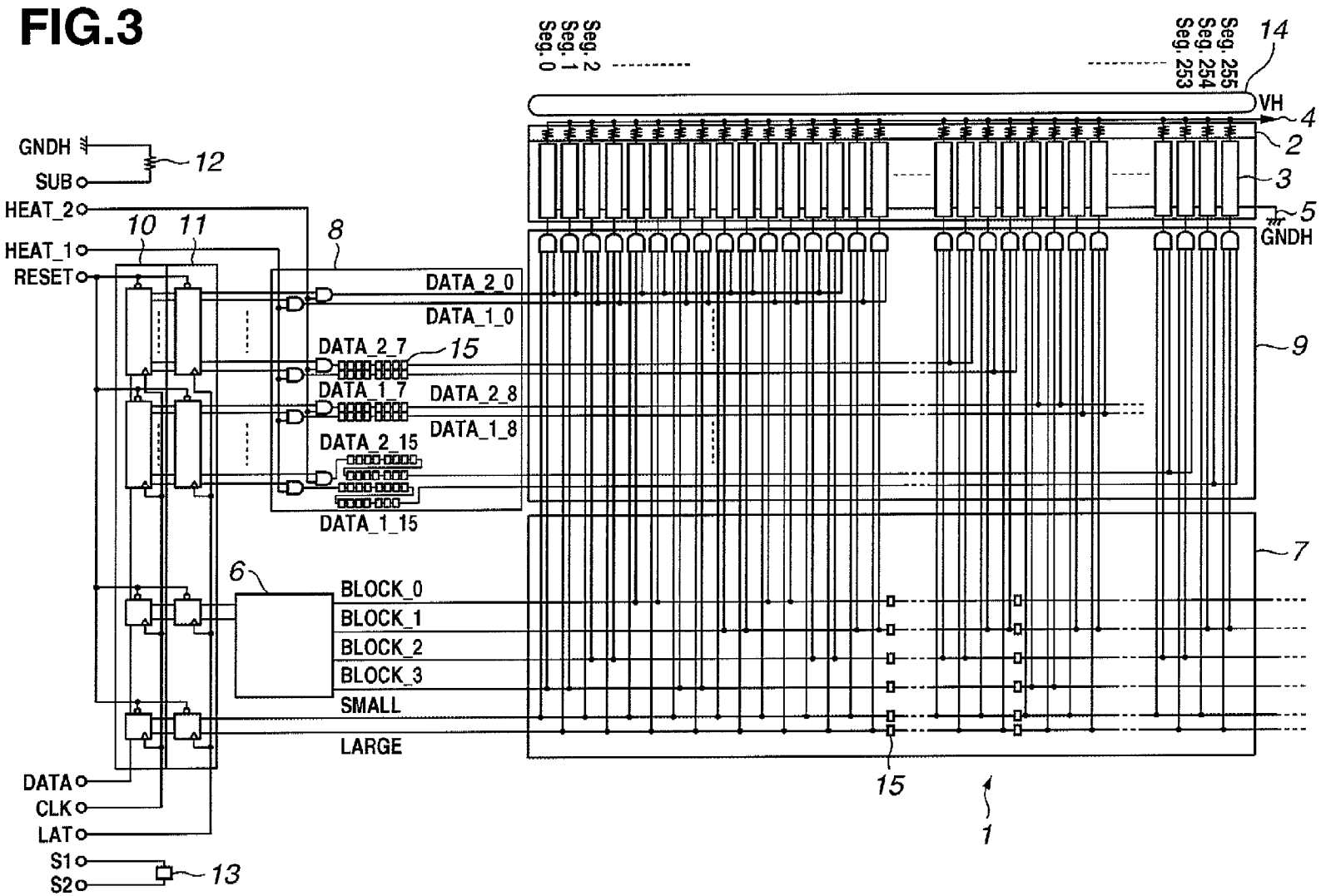
FIG. 3 is a schematic diagram illustrating an exemplary configuration of an inkjet recording head according to another embodiment of the present invention.

FIG. 3 schematically illustrates a characteristic portion (i.e., a characteristic circuit part of a recording head substrate 1) of an inkjet recording head to which a second exemplary embodiment of the present invention is applicable.

Differences from the first exemplary embodiment shown in FIG. 11 to the second exemplary embodiment are described below. A control circuit 6 divides the recording elements into blocks each having 32 nozzles, and selects one of the blocks. Also, the control circuit 6 performs time-divisional driving by inputting time-divisional control signals and by outputting time-divisional driving signals through system wires 7. The control circuit 6 is usually constituted by a decoder circuit or a shift register circuit. An AND-circuit column 8 is used to set an energization time during which electric current is fed to each of the recording elements by a driving pulse. The recording head according to the present embodiment is configured so that adjacent ones of the recording elements differ from one another in heater resistance value and in nozzle shape and can discharge different amounts of ink, respectively. Large and small heaters are alternately disposed as the recording elements.

Also, the recording elements are drive-controlled in units of pairs of large and small heaters. That is, the control circuit drive-controls, in view of the crosstalk, the recording elements in units of pairs of large and small heaters. Each pair of large and small heaters can be controlled by applying energization signals to the terminals HEAT_1 and HEAT_2, respectively. An ANDed output of a signal representing the image data held in the latch circuit 11 and the two signals applied to the terminals HEAT_1 and HEAT_2 is output from AND-circuits through individual control circuit wires 9.

The outputs of the AND-circuits are determined by signals output from AND-circuits and output by the time-divisional driving decoder circuit 6 through the signal system wires 7. These signals are set corresponding to the blocks driven in the recording head, respectively. There are a wide variety of methods of time division, selection circuits, and configurations of wiring and are not limited to the above-described method, circuit and configuration. Each of delay circuits 15 shown in frames 7 and 8 delays a signal by a predetermined time.

A component, which is not numbered in FIG. 3, is a control terminal pad adapted to feed a recording current to the inkjet recording head substrate and to control recording. A plurality of control system wires extended from the time-division driving circuit is provided to run on a surface of the inkjet recording head substrate 1 because the plurality of control system wires are also used even in a case where the recording apparatus is colorized.

A temperature of a recording head substrate itself is raised by feeding electric current to the inkjet recording head. However, in a low temperature environment, both a temperature of ink and a temperature of a head substrate are low. In a case where ink discharge is commenced in the low temperature environment immediately after a recording apparatus is started up, it is frequent that intrinsic ink discharge performance of the recording head cannot be achieved. Thus, the inkjet recording head has a substrate heating sub-heater 12 adapted to perform heat-controlling of the head substrate to change the temperature of the head substrate to a normal temperature of the environment.

Generally, the substrate heating sub-heater 12 includes a resistance element made of a material similar to that of the recording element. The substrate heating sub-heater 12 also includes a substrate temperature sensor 13 used to detect a temperature of the environment. An aluminum resistance element or a diode element, which can be fabricated on the same substrate together with the sub-heater 12, is usually used as the substrate temperature sensor 13. Similar effects can be obtained by directly mounting these elements, which are used for temperature control, on the recording head substrate. In a case where it is necessary to directly detect a temperature of ink, which is in contact with the head substrate, and a temperature of the substrate with good precision, fabrication of the sub-heater 12 and the substrate temperature sensor 13 on the same substrate is optimal. In that case, it is unnecessary to mount a temperature control component in the recording head. Thus, a cost of the recording head can be reduced.

Figure 4:
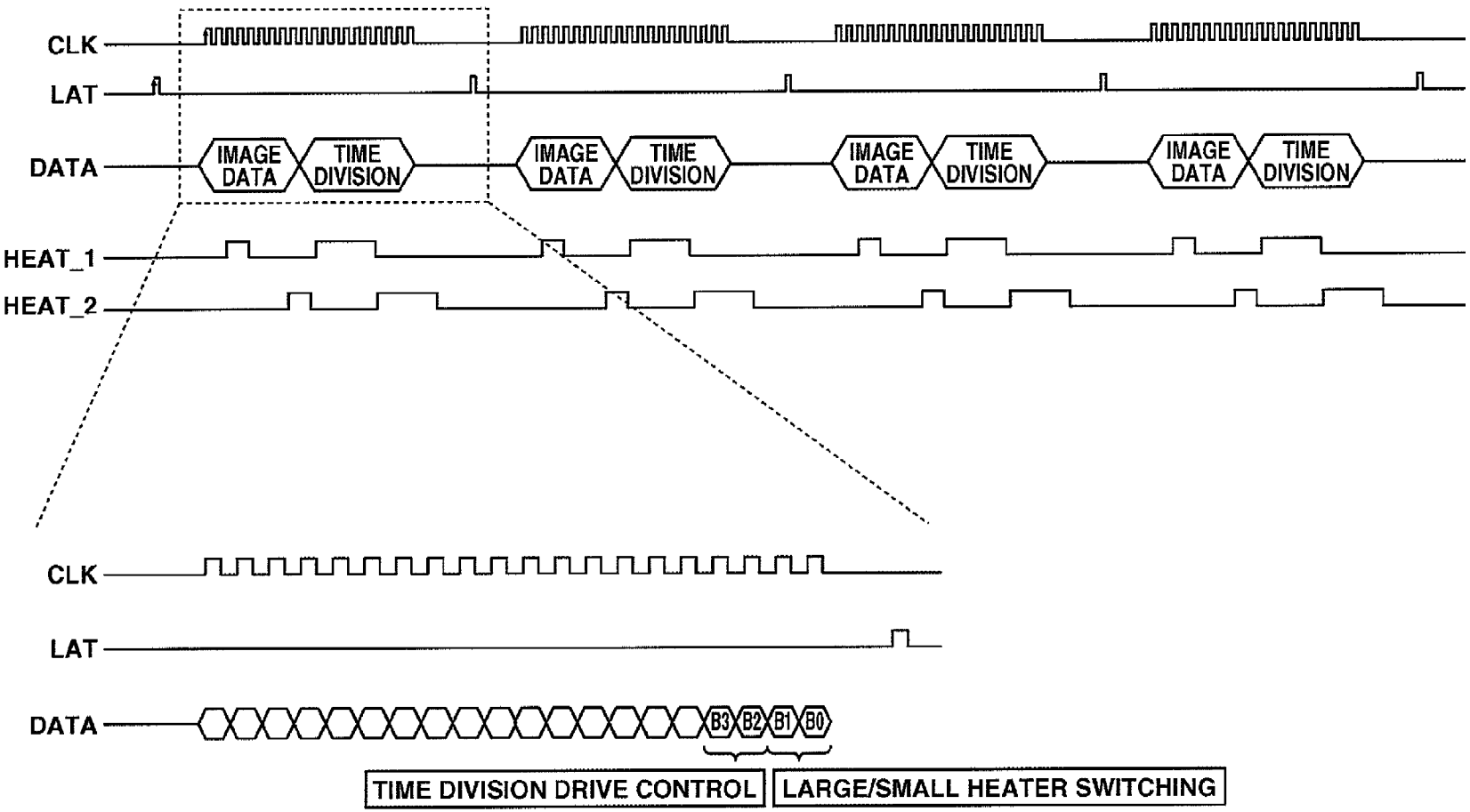
FIG. 4 is a drive timing chart illustrating an exemplary driving operation of the recording head circuit of from FIG. 3 according to an aspect of the present invention.

FIG. 4 is a drive timing chart illustrating an exemplary driving operation of the recording head circuit of the embodiment shown in FIG. 3. This data is basically serial data and is supplied to the shift register circuit 10. In the present embodiment, the data, whose data width corresponds to 256 recording elements, is tentatively held in the latch circuit 11. A latch clock for holding the data is input to a terminal LAT. The data having been held in the latch circuit 11 is held therein until the next data is input thereto and a latch clock is input again to the terminal LAT. While the data is held in the latch circuit 11, the two signals used to energize and control the recording elements are input to the terminals HEAT_1 and HEAT_2. Subsequently, the recording elements are selectively energized according to the image data to record the data.

In recent years, a method has been known, which reduces the number of terminals of the recording head by serially transferring time-divisional drive setting data to a terminal DATA together with image data. FIG. 4 illustrates control data, which is used to individually control the 16 recording elements, and data, which is used to set the number of the block to be time-division driven, by partly enlarging the drive timing chart.

Also, selection data for selecting which of a large heater and a small heater is driven to perform gradation selection, is input to the terminal DATA (hereunder, a signal representing the selection data is referred to as a DATA signal) According to this time sequence, 64 nozzles (incidentally, $16\times2^2=64$) are driven by selecting which of the small heater and the large heater is driven. The control data used to individually control necessary recording elements is set together with the time division setting data (represented by a time-division control signal). This eliminates necessity for providing shift registers and latch circuits used to drive 64 nozzles. Thus, the size of the recording head substrate can largely be reduced.

Also, addition of a serial data bit, which corresponds to the time-divisional drive control, to the control data enables increase of the number of blocks by multiplication thereof by a power of two. Thus, data transfer according to the present embodiment can flexibly deal with increase in the number of recording elements. When the HEAT signal is applied to the terminal after the data is latched, a recording current is fed to the recording elements for a period that is equal in length to the pulse width of the applied HEAT signal. As shown in FIG. 4, the HEAT signals respectively corresponding to the terminals HEAT_1 and HEAT_2 are applied to these terminals, respectively, by being shifted. A total time, in which recording current represented by a signal having a duration being equal to the pulse width is fed, can be shortened within a range of a data transfer clock transmission time. This is a method of shortening a period of ink discharge as much as possible to realize a high speed recording apparatus. Thus, to the extent that the circuit shown in FIG. 3 allows, several timing sequences for driving the recording head can be set. According to a print mode of the recording apparatus, timing can be set.

Figure 6:
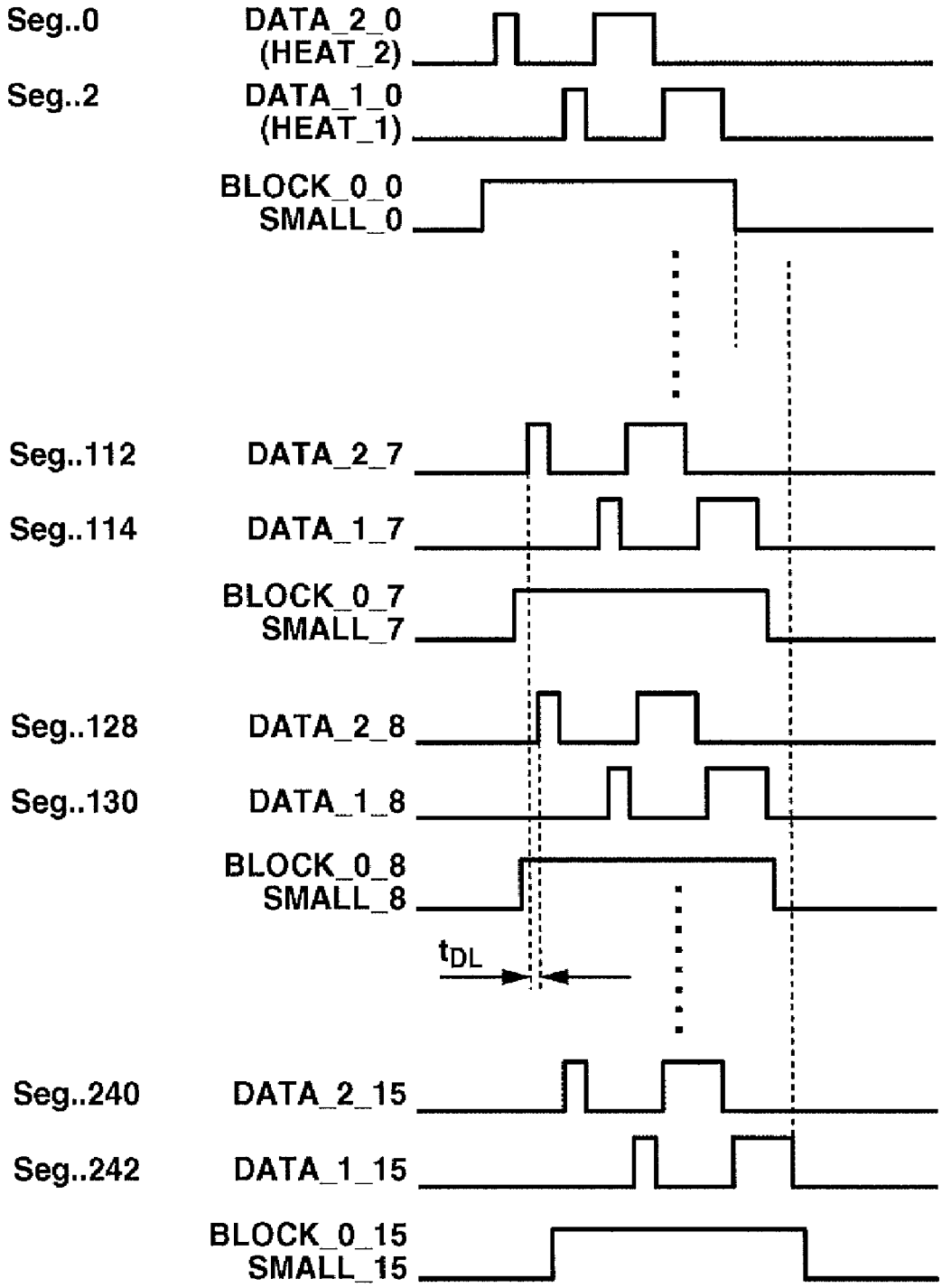
FIG. 6 illustrates an exemplary signal input to each of the recording elements of the recording head circuit from FIG. 3 according to an aspect of the present invention.
Figure 7:
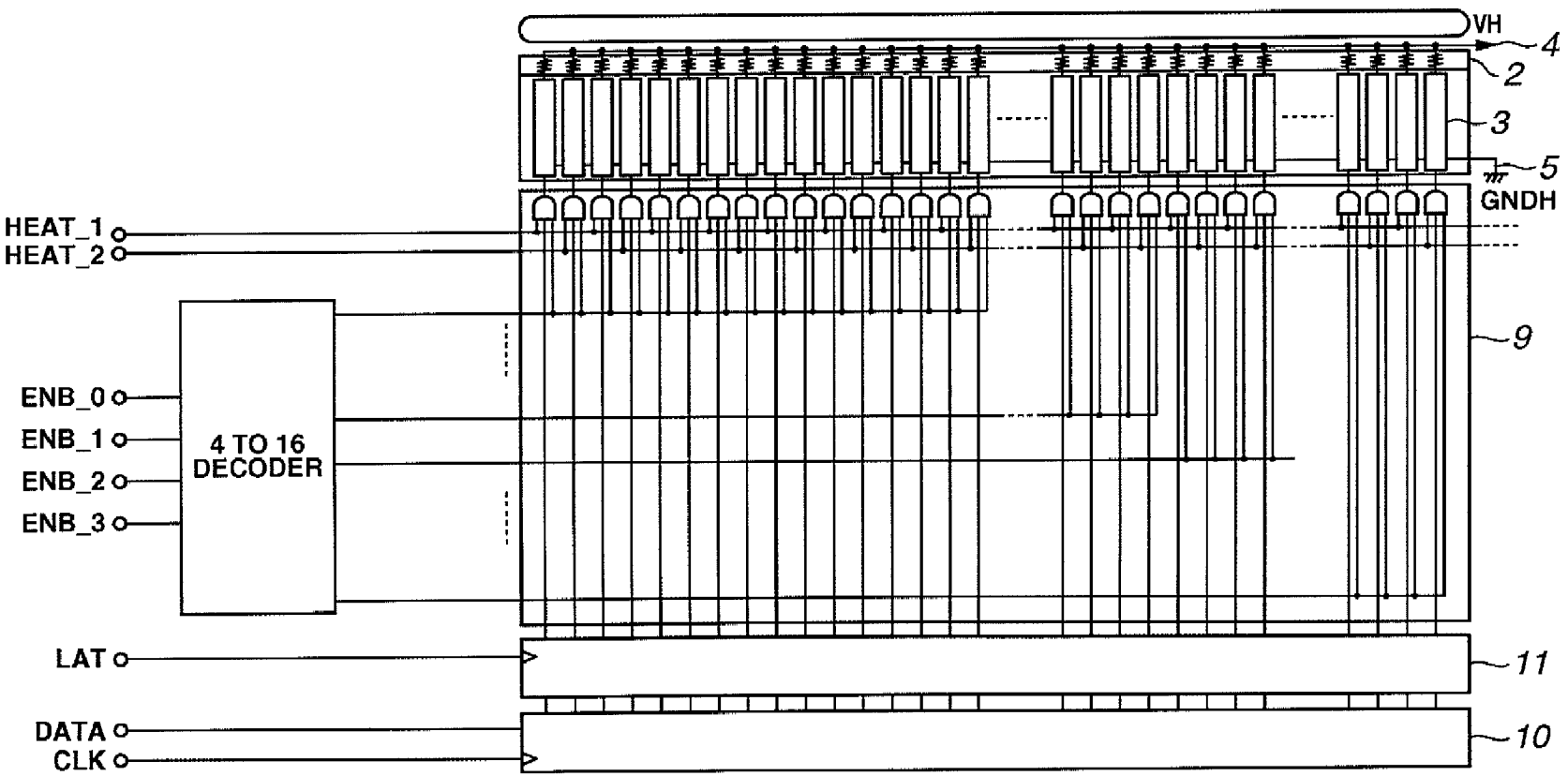
FIG.7 (PRIOR ART)
FIG. 7 is a schematic diagram illustrating a configuration of a conventional inkjet recording head circuit.

FIG. 6 illustrates examples of signals input to recording elements of the recording head circuit shown in FIG. 3. FIG. 6 further illustrates an example of an operation of the delay circuit. In this recording head, no delay is caused by the recording elements Seg. 0 to Seg. 15. A delay period is generated by one delay stage in each of the recording elements Seg. 16 to Seg. 31. Further, delay periods are generated by two delay stages in each of the recording elements Seg. 32 to Seg. 47. In a range of the recording elements ranging from Seg. 48 to Seg. 223, the number of delay stages included in each of the recording elements is incremented by 1 every time the number of recording elements is increased by 16. Finally, in each of the recording elements Seg. 224 and Seg. 225, delay periods are generated by 15 delay stages.

A block signal to each of the recording elements different in the number of delay stages is designated by BLOCK_m_n (m is the number of a block signal, and n is the number of delay stages). Also, a selection signal, which is input to each of the recording elements having different delay stages and which is used to select the large heater or the small heater, is designated by LARGE_n (or SMALL_n) (n is the number of delay stages). Additionally, a signal representing an ANDed product of the signal corresponding to the terminal HEAT_1 (or HEAT_2) and the DATA signal used to select the nozzles is designated by DATA_1_n (or DATA_2_n) (n is the number of delay stages)

FIG. 6 illustrates signals input to the recording elements Seg. 0+16n and 2+16n (n is the number of delay stages), because of the facts that block signals input thereto correspond to the same block signal line (thus, the pulse block signal line BLOCK_0 is common to these block signals) and differ from one another only in the number of delay stages, and that selection signals corresponds to the same heater (thus, the small heater SMALL is common to these selection signals) and differ from one another only in the number of delay stages. Each of the block signal corresponding to the signal line BLOCK_0 and the selection signal corresponding to the small heater SMALL is always held in the latch circuit until a latch clock is input thereto.

Energization pulse signals are input to the terminals HEAT_1 and HEAT_2 by delaying input timing so that the pulses respectively corresponding to the terminals HEAT_1 and HEAT_2 are within the width of each of the pulse signal BLOCK_0 and the selection signal corresponding to the small heater SMALL. Timing, with which the energization signal is input to the terminal HEAT_1 (or HEAT_2), is the same as timing with which the selection signal DATA_1_0 (or DATA_2_0) is input to the terminal DATA. However, because each single delay stage generates a delay period $t_{DL}$, a selection signal DATA_1_7 is delayed from the signal corresponding to the terminal HEAT_1 by 7 times the delay period $t_{DL}$. Also, a selection signal DATA_1_15 is delayed from the block signal from the signal corresponding to the terminal HEAT_1 by 15 times the delay period $t_{DL}$.

Similarly, the signal BLOCK_0_0 (or SMALL_0) input to the recording element Seg. 0 is not delayed. However, the signal BLOCK_0_7 (or SMALL_7) is delayed from the signal BLOCK_0_0 by 7 times the delay period $t_{DL}$. Also, the signal BLOCK_0_15 (or SMALL_15) is delayed from the signal BLOCK_0_0 by 15 times the delay period $t_{DL}$. Therefore, at any nozzle, the signals DATA_1 and DATA_2 are present within duration of the pulse BLOCK_0 (or SMALL). Thus, a sufficient delay time can be taken. In a case where the signal corresponding to the signal line BLOCK_0 and the signal corresponding to the heater SMALL are not delayed, a pulse signal DATA_1_15 is out of duration of the pulse BLOCK_0_0 (or SMALL_0), as is apparent from comparison between the pulses DATA_1_15 and BLOCK_0_0 (or SMALL_0). Thus, sufficient energy is not supplied to the recording element Seg. 226. Consequently, the recording element cannot be driven.

According to the present embodiment, in each single recording element, the number of delay stages corresponding to the signal line BLOCK is set to be always equal to that of delay stages corresponding to the terminal HEAT_1 (or HEAT_2). However, generally, the pulse width of the signal BLOCK is set to be wider than that of the signal HEAT to provide a margin. Therefore, the recording head may be configured to reduce the number of delay stages so that the signal HEAT_1 (or HEAT_2) is present in the duration of the signal BLOCK.

For example, in each recording element, one delay stage is provided corresponding to the signal line BLOCK in a case where two delay stages are provided corresponding to the terminal HEAT_1 (or HEAT_2). Consequently, the present embodiment has an advantage in that the number of delay circuits provided on the signal line BLOCK can be reduced.

As above-described in the description of the second exemplary embodiment, the delay circuit is provided in each of the block selection unit configured to perform time-divisional driving, and the gradation selection unit configured to select one of gradations respectively large and small heaters. Thus, a sufficient delay time is provided. Consequently, the switching noise can be prevented from adversely affecting the recording head.

Also, as above-described, the recording head according to the exemplary embodiment of the present invention includes the delay circuit provided in the block selection unit, in addition to the recording elements, the block selection unit, the input unit adapted to input the pulse width regulating signal, and the delay circuit adapted to delay timing with which the driving pulse signal is applied to recording elements. Thus, even in a case where the number of heating elements to be simultaneously driven is increased together with increase in the number of recording elements and the number of discharge ports, which are indispensable to achieve high-speed printing, influence of noises on an image data control line can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2005-372521 filed Dec. 26, 2005, which is hereby incorporated by reference herein in its entirety.

What is claimed:

1. A recording head comprising:

a plurality of recording elements;

a block selection unit configured to divide the recording elements into blocks, each of which has a plurality of the recording elements, and to select a block according to a time-divisional driving signal used to perform time-divisional driving in units of the blocks;

an input unit configured to input a pulse width regulating signal used to regulate a width of a driving pulse signal to be applied to each of the recording elements;

a first common signal line configured to transfer a block driving signal output from the block selection unit to a recording element included in a block;

a second common signal line configured to transfer the pulse width regulating signal input by the input unit to the plurality of recording elements; and a first delay circuit disposed on the first common signal line and a second delay circuit disposed on the second common signal line, wherein the first and second delay circuits are configured to delay the block driving signal and the pulse width regulating signal, respectively.

2. The recording head according to claim 1, wherein the first and second delay circuits include a buffer circuit.

3. The recording head according to claim 1, wherein the first and second delay circuits include a low-pass filter.

4. A recording head comprising:

a plurality of recording elements;

a decoder configured to output a signal for selecting a timing of driving a recording element included in the plurality of recording elements from a plurality of timings;

a driver disposed for each recording element and configured to drive a recording element;

a logic circuit disposed for each driver and configured to output a result of a calculation of a signal output from the decoder and a pulse width regulating signal for defining a width of a pulse signal applied to the drive;

a first common signal line configured to transfer a signal output from the decoder to a plurality of logic circuits;

a second common signal line configured to transfer the pulse width regulating signal to the plurality of logic circuits; and a first delay circuit disposed on the first common signal line and a second delay circuit disposed on the second common signal line, wherein the first and second delay circuits are configured to delay a signal output from the decoder and a pulse width regulating signal, respectively.

5. The recording head according to claim 4, wherein the first and second delay circuits include a buffer circuit.

6. The recording head according to claim 4, wherein the first and second delay circuits include a low-pass filter.

* * * * *